US009895821B2

(12) United States Patent
Wada

(10) Patent No.: US 9,895,821 B2
(45) Date of Patent: Feb. 20, 2018

(54) WEB CUTTING DEVICE AND WEB CUTTING METHOD

(71) Applicant: ZUIKO CORPORATION, Settu-shi, Osaka (JP)

(72) Inventor: Takao Wada, Settu (JP)

(73) Assignee: ZUIKO CORPORATION, Settu-Shi, Osaka (JP)

( * ) Notice: Subject to any disclaimer, the term of this patent is extended or adjusted under 35 U.S.C. 154(b) by 174 days.

(21) Appl. No.: 15/033,411

(22) PCT Filed: Oct. 31, 2014

(86) PCT No.: PCT/JP2014/079031

§ 371 (c)(1),
(2) Date: Apr. 29, 2016

(87) PCT Pub. No.: WO2015/068646

PCT Pub. Date: May 14, 2015

(65) Prior Publication Data

US 2016/0257018 A1 Sep. 8, 2016

(30) Foreign Application Priority Data

Nov. 8, 2013 (JP) ..... 2013-231742

(51) Int. Cl.
*B26D 7/26* (2006.01)
*B26D 1/40* (2006.01)
(Continued)

(52) U.S. Cl.
CPC ..... *B26D 7/26* (2013.01); *B26D 1/405* (2013.01); *B26D 1/42* (2013.01); *B26D 1/425* (2013.01);
(Continued)

(58) Field of Classification Search
CPC . B26D 7/26; B26D 1/425; B26D 1/42; B26D 1/626; B26D 1/405
(Continued)

(56) References Cited

U.S. PATENT DOCUMENTS 4,240,313 A * 12/1980 Gillespie ..... A24C 5/473 83/343
4,799,414 A 1/1989 Scheffer et al.
(Continued)

FOREIGN PATENT DOCUMENTS

DE 102007058819 A1 6/2009
GB 2036628 A 7/1980
(Continued)

OTHER PUBLICATIONS

Japan Patent Office, "Office Action for Japanese Patent Application No. 2015-546622," dated May 23, 2017.
(Continued)

*Primary Examiner* — Sean Michalski
(74) *Attorney, Agent, or Firm* — Manabu Kanesaka

(57) ABSTRACT

In a web cutting device, a web held by pads has a section between mutually adjacent pads that is sandwiched between an anvil and a blade edge of a cutter and cut. A stop member is fixed in a rotating member. The cutter is biased by a biasing member and comes in contact with the stop member. The stop member obstructs travel by the cutter towards the outside in the radial direction of the rotating member, when the cutter comes in contact with the stop member. The biasing member biases the cutter to the outside in the radial direction of the rotating member and causes the cutter to come in contact with the stop member, by using a predetermined biasing force, and allows the cutter to retreat when the reaction force acting on the cutter is greater than the predetermined biasing force.

12 Claims, 13 Drawing Sheets

(51) Int. Cl.
*B26D 7/01* (2006.01)
*B26D 1/62* (2006.01)
*B26D 1/42* (2006.01)

(52) U.S. Cl.
CPC ..... *B26D 1/626* (2013.01); *B26D 7/018* (2013.01); *B26D 2007/2685* (2013.01)

(58) Field of Classification Search
USPC ..... 83/304, 331
See application file for complete search history.

(56) References Cited

U.S. PATENT DOCUMENTS 4,913,013 A 4/1990 Osborn
4,914,995 A 4/1990 Osborn
4,962,683 A 10/1990 Scheffer et al.
4,982,637 A 1/1991 Osborn
5,086,683 A * 2/1992 Steidinger ..... B26D 7/2614 83/346
5,797,305 A * 8/1998 Harrod ..... B26D 1/626 83/304
5,806,395 A * 9/1998 Dafler ..... B23K 37/08 83/285
5,957,020 A * 9/1999 Truemner ..... B26F 1/0076 83/304
6,030,481 A 2/2000 Winter et al.
6,553,883 B1 * 4/2003 Adami ..... B26D 1/425 493/22
6,604,444 B1 * 8/2003 Belanger ..... B26D 1/626 83/117
2001/0009883 A1 * 7/2001 Couturier ..... B26D 1/626 493/123
2002/0066347 A1 * 6/2002 Plasswich ..... B26D 1/185 83/338
2004/0074355 A1 * 4/2004 Rankin, Sr. ..... B27G 13/04 83/14
2004/0094006 A1 * 5/2004 McGarvey ..... B26D 1/42 83/303
2004/0194596 A1 * 10/2004 Achelpohl ..... B26D 1/425 83/304
2008/0289468 A1 11/2008 Nakakado et al.
2011/0265619 A1 * 11/2011 McCabe ..... A61F 13/15723 83/23
2014/0097569 A1 * 4/2014 Sposato, Jr. ..... B41F 13/60 270/20.1
2015/0165635 A1 * 6/2015 Pringal ..... B26F 1/08 225/2

FOREIGN PATENT DOCUMENTS

JP S54-17477 U 2/1979
JP 2002-284540 A 10/2002
JP 2005-28526 A 2/2005
JP 2005-103752 A 4/2005
JP 2007-117226 A 5/2007
JP 2008-100303 A 5/2008

OTHER PUBLICATIONS

Europe Patent Office, "Search Report for European Patent Application No. 14859535.8," dated Jun. 9, 2017.
Japan Patent Office, "Office Action for Japanese Patent Application No. 2015-546622," dated Feb. 28, 2017.
PCT International Search Report of PCT/JP2014/079031.

* cited by examiner (a)

(b)

WEB CUTTING DEVICE AND WEB CUTTING METHOD

RELATED APPLICATIONS

The present application is National Phase of International Application No. PCT/JP2014/079031 filed Oct. 31, 2014, and claims priority from Japanese Application No. 2013-231742, filed Nov. 8, 2013.

TECHNICAL FIELD

The present invention relates to a web cutting device and a web cutting method and, in particular, to a web cutting device and a web cutting method for cutting a web.

BACKGROUND OF THE INVENTION

In the conventional art, in production of disposable underpants, disposable diapers, or the like, a web cutting device is employed that, after cutting a web, conveys individual cut pieces and changes the orientations of the individual pieces during the conveyance.

An example of such a web cutting device is shown, for example, in FIGS. 11 to 15. FIG. 12 is a schematic perspective view showing the state of carrying a web. As shown in FIG. 12, a web W is conveyed along the cylindrical outer peripheral surface of a stationary drum indicated by a dashed dotted line, in the circumferential direction indicated by an arrow D1 and then the web W is cut. Then, individual pieces W2 obtained by cutting are conveyed with changing the orientation, and then transferred to a subsequent device at a delivery position SP.

FIG. 11 is a schematic diagram showing the configuration of a web cutting device. FIG. 15 is a sectional diagram showing the configuration of a web cutting device. As shown in FIGS. 11 and 15, a plurality of travel members 113 are held in a freely movable manner along the outer peripheral surface of a stationary drum 150. Anvils A1, A2, . . . , Ai, . . . , An moving together with the travel members 113 are arranged between the travel members 113 adjacent to each other.

Each travel member 113 supports in a revolvable manner a shaft member 114 whose center axis r extends in a radial direction of the stationary drum 150. In the shaft member 114, a pad P1, P2, . . . , Pi, . . . , Pn for vacuum-holding the web W is fixed to one end on the radial-directional outer side of the stationary drum 150. Further, a cam follower 115 for engaging with a cam groove 151 formed in the outer peripheral surface of the stationary drum 150 is formed at the other end on the radial-directional center side of the stationary drum 150. In the travel member 113, a groove member 121*b* for engaging with a protruding part 121*a* fixed to the stationary drum 150 is fixed and then the protruding part 121*a* and the groove member 121*b* constitute a guiding part 121 for guiding the travel member 113. Then, the travel member 113 is held in a freely movable manner along the outer peripheral surface of the stationary drum 150.

The travel member 113 is linked through links 111 and 112 to a revolving body 120 and moves along the outer peripheral surface of the stationary drum 150 in association with revolution of the revolving body 120. At that time, the cam follower 115 formed at the other end of the shaft member 114 supported in a rotatable manner by the travel member 113 engages with the cam groove 151 formed in the outer peripheral surface of the stationary drum 150. Thus, the shaft member 114 reciprocally rotates about the center axis r within a range of 90°. By virtue of this, as shown in a developed view of FIG. 13, the orientations of pads P1, P2, . . . , Pn vary within a range of 90° between a parallel direction and a perpendicular direction relative to the moving direction indicated by a dashed dotted line, that is, the circumferential direction of the stationary drum.

FIGS. 14(*a*) and 14(*b*) are main part enlarged views at the time of web cutting. As shown in FIGS. 13, 14(*a*), and 14(*b*), the web W is conveyed from a receiving position RP toward a cutting position CP in the direction of arrow D1. A cutting unit 130 is arranged such as to face the cutting position CP. In the cutting unit 130, a cutter 131 is fixed to a revolving member 132. The revolving member 132 revolves in the direction of arrow D2 in synchronization with conveyance of the web W. As shown in FIG. 14(*b*), in the web W, when a portion extending between the two pads Pn and P1 passes the cutting position CP, the portion is pinched between the tip surface As of the anvil A1 and the blade edge of the cutter 131 so as to be cut.

As shown in FIG. 15, the center axis X1 of the stationary drum 150 and the center axis X2 of the revolving body 120 are distant from each other. The anvils A1, A2, . . . , An are held in a freely movable manner along a cylindrical surface coaxial to the center axis X2 of the revolving body 120 and then, as shown in FIG. 11, at the delivery position SP, retract from the conveyance path for the web moved and held by the pad Pi (for example, see Patent Document 1).

PRIOR ART REFERENCES

Patent Documents

Patent Document 1: Japan Patent Publication No. 4745061

SUMMARY OF THE INVENTION

Problem to be Solved by the Invention

When the interval between the cutter and the anvil is excessively large, the web cannot satisfactory be cut. On the contrary, when the interval between the cutter and the anvil vanishes and the cutter strongly abuts against the anvil, the cutter is worn away so that a situation is soon caused that the web cannot satisfactorily be cut. Thus, the interval or the abutting strength between the cutter and the anvil need be adjusted with precision in accordance with the thickness and the material of the web.

Nevertheless, the work of adjusting the position of the tip surface of each of the plurality of anvils relative to the cutter with precision is complicated. Further, even when the position of the tip surface of the anvil can be adjusted with precision, the interval or the abutting between the cutter and the anvil easily varies owing to vibration, thermal expansion, or the like during the operation. Thus, adjustment of the interval or the abutting between the cutter and the anvil is performed in a state that the device is stopped. Thus, long-term continuous operation of the web cutting device is not easy.

In view of such situations, a problem to be solved by the present invention is to provide a web cutting device and a web cutting method in which long-term continuous running becomes easy.

Means for Solving the Problem

The present invention for resolving the above-mentioned problem provides a web cutting device having the following construction.

A web cutting device includes: (a) a plurality of pads that move in a circumferential direction along a cylindrical movement path and hold a web in a releasable manner; (b) a plurality of anvils that are arranged between the pads adjacent to each other and that move in the circumferential direction together with the pads; (c) a revolving member that is arranged, with an interval in between, opposite to the web moved in a state of being held by the pads and that revolves in synchronization with movement of the anvils; (d) a cutter that is held by the revolving member in a manner of being retractable from a predetermined position toward the inner side of the revolving member and that has a blade edge protruding to the outer side of the revolving member and, when the blade edge becomes such as to face the anvil in association with revolution of the revolving member, cuts the web pinched between the blade edge and the anvil; and (e) a biasing member that biases the cutter to the outer side of the revolving member by using a predetermined biasing force so as to hold the cutter at the predetermined position and, on the other hand, when a reaction force acting on the blade edge of the cutter is greater than the predetermined biasing force, allows the cutter to retract from the predetermined position.

In the web cutting device having the above-mentioned configuration, the web is held by the pads. Then, a portion of the web extending between the pads adjacent to each other is pinched between the anvil and the blade edge of the cutter so as to be cut. Then, the individual pieces obtained by cutting from the web are conveyed in a state of being held by the pads and then the individual pieces are released from the pads.

According to the above-mentioned configuration, when the biasing force generated by the biasing member is appropriately designed, a situation can be realized that abutting of the cutter to the anvil is excessively strong or excessively weak. Further, even when the interval or the abutting between the cutter and the anvil varies owing to vibration, thermal deformation, or the like during the operation, the abutting can be maintained within an appropriate adjustment range. Thus, long-term continuous running becomes easy.

Preferably, the revolving member includes a stop part that prevents movement of the cutter biased by the biasing member and thereby holds the cutter at the predetermined position.

In this case, the configuration of holding the cutter at a predetermined position becomes simple.

Preferably, the biasing member is a spring member and is arranged in an inside of the revolving member.

In this case, a configuration can easily be realized that the cutter is biased by a predetermined biasing force and then, when the reaction force is greater than the predetermined biasing force, the cutter retracts. Further, size reduction can easily be achieved. Furthermore, the spring member is excellent in durability in comparison with rubber or the like and hence is preferable in long-term continuous running.

Preferably, the revolving member includes a biasing force adjusting member capable of changing the biasing force of the biasing member.

In this case, the predetermined biasing force for biasing the cutter can be changed and adjusted by means of adjustment by the biasing force adjusting member.

Preferably, the spring member is a compression spring. The revolving member is provided with a body enclosing a rotational center axis of the revolving member and with a stop member fixed to the body and constituting the stop part. That is, the stop member prevents the movement of the cutter biased by the compression spring so as to hold the cutter at the predetermined position. In the body, formed are: (a) a groove which extends in parallel to the rotational center axis and in which the stop member is arranged; (b) a spring hole which is in fluid communication with the groove, which extends perpendicularly to the rotational center axis, and in which the compression spring is arranged in a compressed state; and (c) a threaded hole that extends perpendicularly to the rotational center axis from the spring hole to a side opposite to the groove and that is in fluid communication with an outside. The biasing force adjusting member is a screw member screwed into the threaded hole. A compression amount of the compression spring can be changed in accordance with a length of protrusion of the screw member into the spring hole.

In this case, the stop member can be positioned by the groove. In a case that a helical compression spring is arranged in the spring hole, the configuration can be made small. The predetermined biasing force for biasing the cutter can be changed by adjusting in accordance with the length of into-the-spring-hole protrusion of the screw member serving as a biasing force adjusting member. Further, the compression amount of the compression spring can easily be changed from the outside by rotating the screw member.

Preferably, the spring member is a compression spring. The revolving member is provided with a body enclosing a rotational center axis of the revolving member and with a plurality of stop members fixed to the body and constituting the stop parts. That is, the stop member prevents the movement of the cutter biased by the compression springs so as to hold the cutter at the predetermined position. In the body, a through hole is formed that extends perpendicularly to the rotational center axis and passes through the rotational center axis. The compression spring is arranged in the through hole. The stop members are fixed to the body respectively on one-end side and the other end side of the through hole. The cutters are respectively arranged on one-end side and the other end side of the through hole, then each located between the compression spring in a compressed state and the stop member, and then biased to a radial-directional outer side of the revolving member by the compression spring.

In this case, when two cutters are attached to the revolving member, the replacement cycle of the cutter can be extended in comparison with a case that one cutter is attached to the revolving member. Further, since a common compression spring biases the two cutters, the configuration can be simplified.

In a preferable mode, the cutter has bulged parts protruding to both sides of a direction parallel to the direction in which the blade edge extends. When the cutter is held at the predetermined position by the revolving member, the bulged parts abut against the stop part of the revolving member and then, when the cutter retracts from the predetermined position, depart from the stop part of the revolving member.

In another preferable mode, the cutter has a bulged part protruding to both sides of a thickness direction. When the cutter is held at the predetermined position by the revolving member, the bulged part abuts against the stop part of the revolving member and then, when the cutter retracts from the predetermined position, departs from the stop part of the revolving member.

Preferably, the revolving member has a through hole into which the blade edge of the cutter and a portion continuous to the blade edge are inserted.

In this case, the number of stop members can be reduced so that the configuration can be simplified. Further, the retraction movement of the cutter can be guided by the through hole.

Further, the present invention provides a web cutting method having the following construction.

A web cutting method includes: (i) a first step of moving a plurality of pads and a plurality of anvils arranged alternately along a cylindrical movement path, in a circumferential direction of the movement path; (ii) a second step of holding a web by using the pads moving at the first step and conveying the web in a state that the anvil moving at the first step faces a portion of the web extending between the pads adjacent to each other; and (iii) a third step of, in a state that a cutter is held by a revolving member and then the cutter is biased to a predetermined position by a biasing force from a biasing member arranged in the revolving member so that a blade edge of the cutter is caused to protrude, revolving the revolving member in synchronization with movement of the anvils at the first step and thereby pinching, between the blade edge of the cutter and the anvil, the web conveyed at the second step so as to cut the web. At the third step, when a reaction force greater than the biasing force acts on the blade edge of the cutter, the biasing member allows the cutter to retract from the predetermined position toward an inner side of the revolving member.

According to the method described above, even when the interval or the abutting between the cutter and the anvil varies owing to vibration, thermal deformation, or the like during the operation, the abutting can be maintained within an appropriate adjustment range. Thus, long-term continuous running becomes easy.

Preferably, the biasing member is a spring member.

In this case, the spring member is excellent in durability in comparison with rubber or the like and hence is preferable in long-term continuous running.

Preferably, the spring member is a helical compression spring arranged in an inside of the revolving member. The revolving member holds a pair of the cutters arranged on both sides in an axial direction of the helical compression spring in a compressed state and then causes the blade edges of a pair of the cutters to protrude in opposite directions to each other.

In this case, the replacement cycle of the cutter can be extended in comparison with a case that the revolving member holds one cutter. Further, the configuration can be simplified by employing the common helical compression spring.

Effect of the Invention

According to the present invention, long-term continuous running becomes easy.

MODE FOR CARRYING OUT THE INVENTION

Embodiments serving as modes of implementation of the present invention are described below with reference to FIGS. 1 to 10.

Embodiment 1

A web cutting device and a web cutting method of Embodiment 1 are described below with reference to FIGS. 1 to 4.

Figure 1:
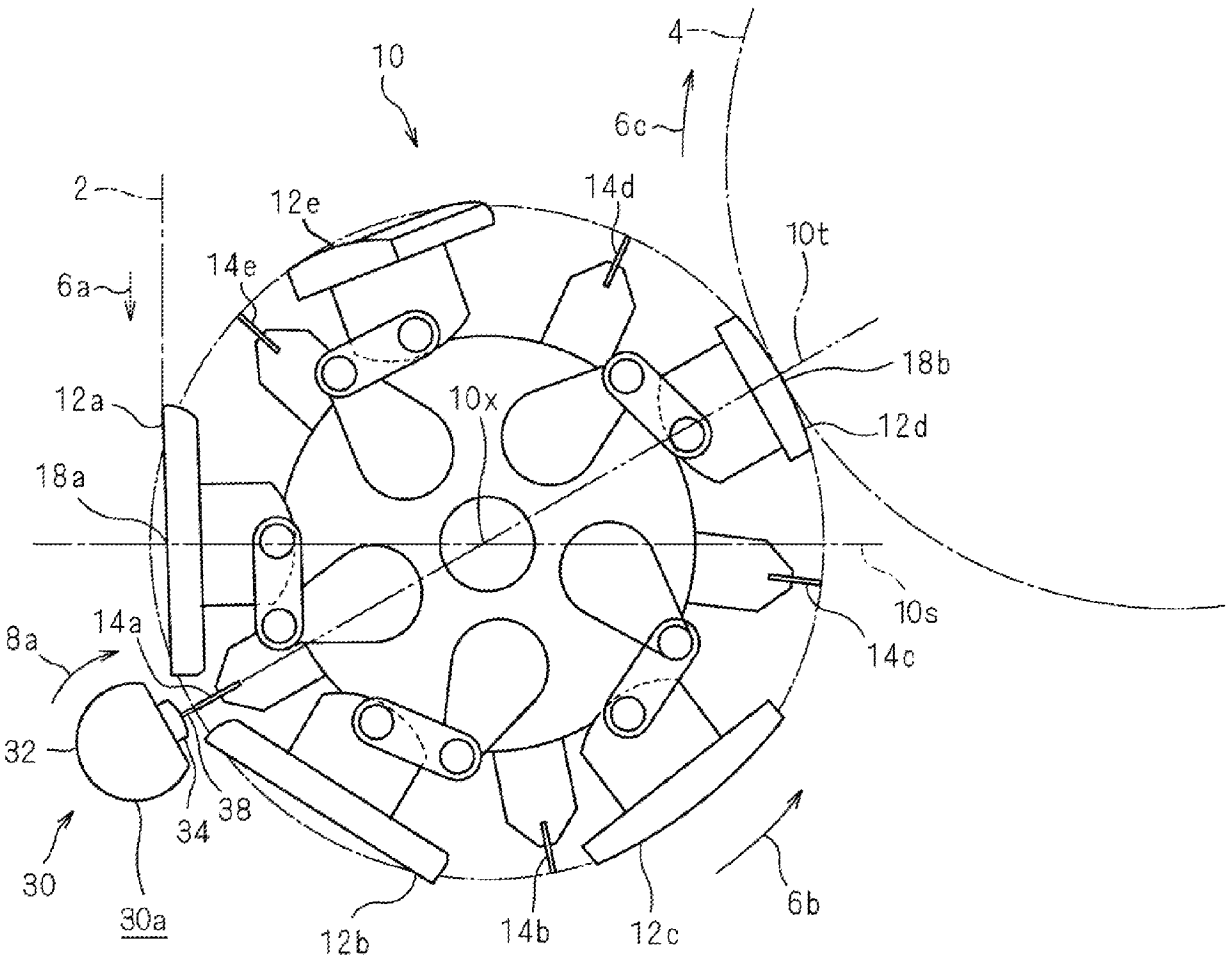
FIG. 1 is a schematic diagram showing the configuration of a web cutting device. (Embodiment 1)

FIG. 1 is a schematic diagram showing the configuration of a web cutting device 10. As shown in FIG. 1, pads 12*a* to 12*e* and anvils 14*a* to 14*e* are along the cylindrical outer peripheral surface of a stationary drum (not shown), alternately in the circumferential direction of the outer peripheral surface of the stationary drum. Then, as indicated by an arrow 6*b*, the pads 12*a* to 12*e* and the anvils 14*a* to 14*e* move in the circumferential direction of the outer peripheral surface of the stationary drum. That is, at a first step of a web cutting method, the plurality of pads 12*a* to 12*e* and the plurality of anvils 14*a* to 14*e* arranged alternately along a cylindrical movement path are moved in the circumferential direction of the movement path.

A vacuum suction hole (not shown) for vacuum-holding a web 2 is formed in the surface of each of the pads 12*a* to 12*e*. At a receiving position 18*a*, the web 2 is vacuum-held by the pad 12*a* and then conveyed in the direction indicated by an arrow 6*a* in accordance with the movement of the pad 12*a*. At that time, the anvil 14*a* faces a portion of the web 2 extending between the pads 12*a* and 12*b* adjacent to each other. That is, at a second step of the web cutting method, the web 2 is held by the pads 12*a* to 12*d* moving at the first step and then, the web 2 is conveyed in a state that the anvil 14*a* moving at the first step faces a portion of the web extending between the pads 12*a* and 12*b* adjacent to each other.

Then, at a cutting position, a portion of the web 2 extending between the pads 12*a* and 12*b* adjacent to each other is pinched between a blade edge 38*a* of a cutter 38 of a cutting unit 30 (see FIG. 2) and the anvil 14*a* so as to be cut. That is, at a third step of the web cutting method, the web 2 is pinched between the blade edge 38*a* of the cutter 38 and the anvil 14*a* so as to be cut.

In the cutting unit 30, the cutter 38 is held by a revolving member 30*a*. The revolving member 30*a* includes: a body 32 enclosing the rotational center axis of the revolving member 30*a*; and a stop member 34. The revolving member 30*a* is arranged such that the rotational center axis of the revolving member 30*a* becomes parallel to the center axis of the outer peripheral surface of the stationary drum. Then, the revolving member 30*a* faces, with an interval in between, the web moved in a state of being held by the pads 12*a* to 12*d*. The revolving member 30*a* revolves in the direction indicated by an arrow 8*a* in synchronization with the movement of the anvils 14*a* to 14*e* in such a manner that the cutter 38 faces each of the anvils 14*a* to 14*e*.

An individual piece (not shown) obtained by cutting from the web 2 is conveyed in a state of being vacuum-held by the pad 12*b* and then, at a delivery position 18*b*, the individual piece is transferred from the pad 12*d* to a device 4 of the subsequent process. The device 4 of the subsequent process conveys the transferred individual piece in the direction indicated by an arrow 6*c*.

Each of the pads 12*a* to 12*e* moves with changing the orientation relative to the circumferential direction of the stationary drum. That is, in a first interval from the cutting position where the cutter 38 and the anvil 14*a* face to each other to the delivery position 18*b* in the moving direction of the pad, the pad changes its orientation by 90° relative to the circumferential direction of the stationary drum. In a second interval from the delivery position 18*b* to the receiving position 18*a* in the moving direction of the pad, the pad restores the orientation relative to the circumferential direction of the stationary drum.

When the first interval is set to be 180° or smaller and the second interval is set to be 180° or smaller, the web cutting device can be constructed in a satisfactory balance. Further, in order that the orientation of the pad may stably be changed, it is preferable that the first and the second interval where the orientation of the pad is changed are made as long as possible and that the distance from the receiving position 18*a* to the cutting position is made as short as possible. Thus, the delivery position 18*b* is arranged in an acute angle region between the extension line 10*s* of the imaginary line joining the center axis 10*x* of the stationary drum and the receiving position 18*a* and the extension line 10*t* of the imaginary line joining the center axis 10*x* of the stationary drum and the cutting position.

Figure 2:
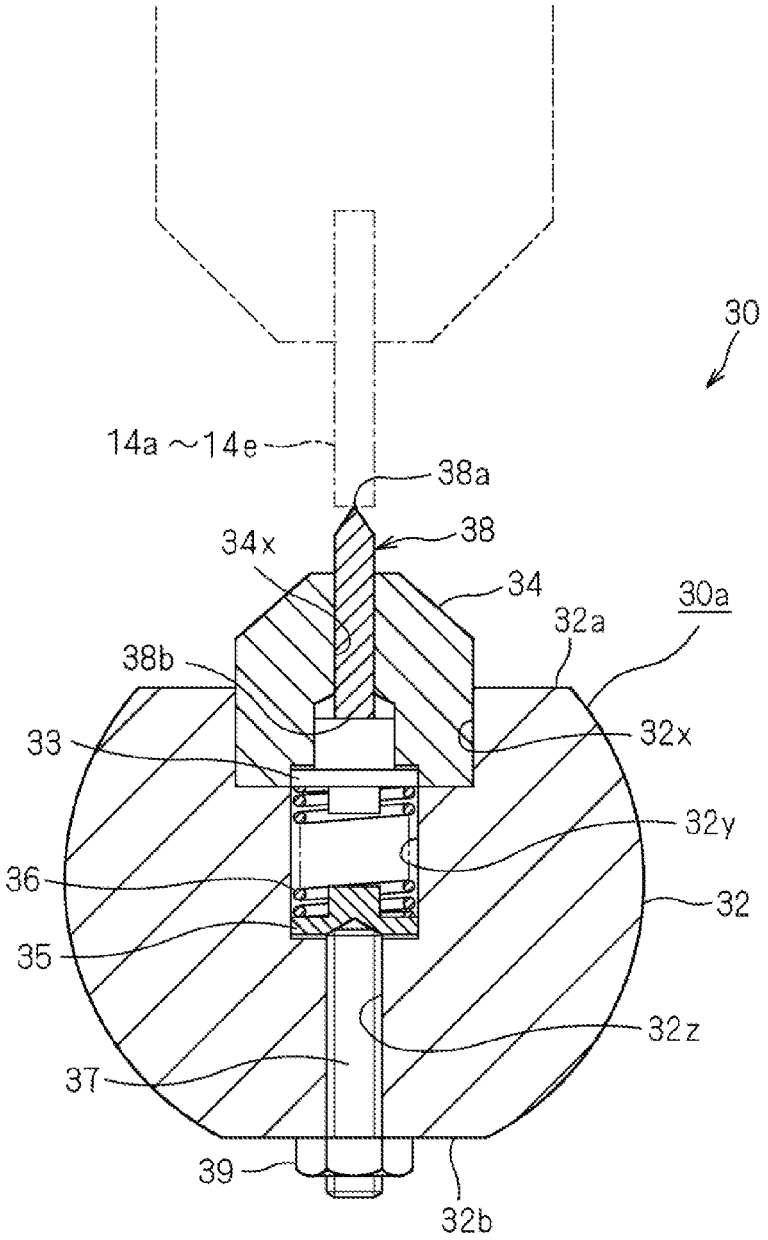
FIG. 2 is a sectional view of a cutting unit. (Embodiment 1)
Figure 3:
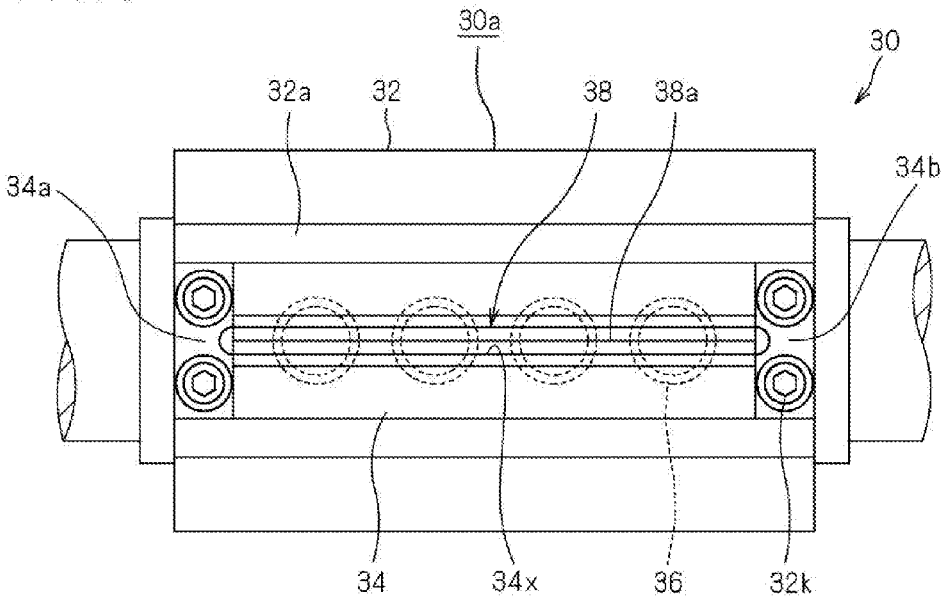
FIG. 3 is a plan view of a cutting unit. (Embodiment 1)
Figure 4:
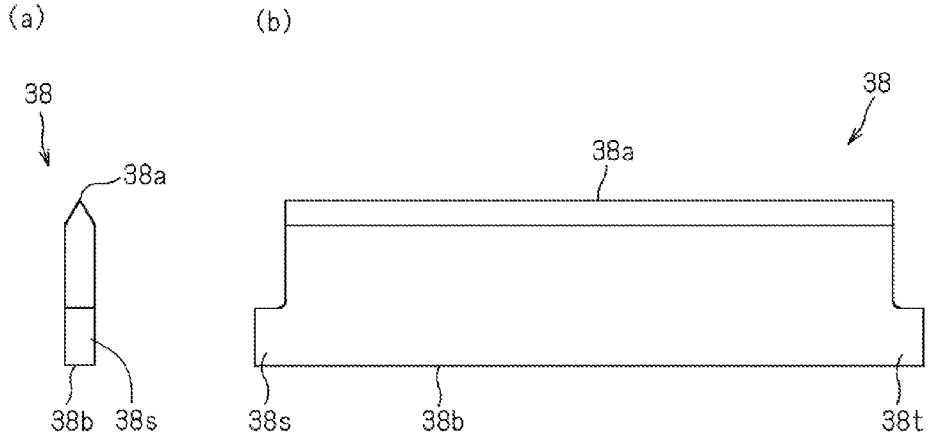
FIG. 4(*a*) is a side view of a cutter and FIG. 4(*b*) is a front view of a cutter. (Embodiment 1)

Next, the cutting unit 30 is described further with reference to FIGS. 2 to 4. FIG. 2 is a sectional view of the cutting unit 30. FIG. 3 is a plan view of the cutting unit 30.

As shown in FIGS. 2 and 3, the cutter 38 protrudes from the stop member 34 of the revolving member 30*a*. Then, the blade edge 38*a* of the cutter 38 extends in parallel to the rotational center axis of the revolving member 30*a* and then the blade edge 38*a* becomes such as to face the anvil 14*a* in association with revolution of the revolving member 30*a*.

In the body 32 of the revolving member 30*a*, planes 32*a* and 32*b* are formed that extend in parallel to the axial direction of the revolving member 30*a* and that are parallel to each other. In one plane 32*a*, a groove 32*x* is formed that extends in the axial direction of the revolving member 30*a*, that is, in parallel to the rotational center axis of the revolving member 30*a*. Further formed are: a plurality of spring holes 32*y* in fluid communication with the groove 32*x* and extending in a radial direction of the revolving member 30*a*, that is, perpendicularly to the rotational center axis of the revolving member 30*a*, so as to pass through the rotational center axis of the revolving member 30*a*; and threaded holes 32*z* each extending from the spring hole 32*y* to a side opposite to the groove 32*x* in the radial direction of the revolving member 30*a*, that is, perpendicularly to the rotational center axis of the revolving member 30*a* and reaching the other plane 32*b*.

The stop member 34 is inserted into the groove 32*x* and then fixed to the body 32 of the revolving member 30*a* by using a bolt 32*k*. In the stop member 34, a through hole 34*x* is formed into which the blade edge 38*a* side of the cutter 38 is inserted.

In the spring hole 32*y*, a helical compression spring 36 is arranged in a compressed state. Washers 33 and 35 are arranged at both ends of the helical compression spring 36. The helical compression spring 36 is a biasing member.

In the threaded hole 32*z*, a screw member 37 is arranged that is screwed into the threaded hole 32*z*. The position of the screw member 37 is fixed by tightening a nut 39 screwed onto the screw member 37.

FIG. 4(*a*) is a side view of the cutter 38. FIG. 4(*b*) is a front view of the cutter 38. As shown in FIGS. 4(*a*) and 4(*b*), the cutter 38 has bulged parts 38*s* and 38*t* protruding to both sides of a direction parallel to the direction in which the blade edge 38*a* extends.

In the cutter 38, as shown in FIGS. 2 and 3, the blade edge 38*a* of the cutter 38 and a portion continuous to the blade edge 38*a* are inserted through the through hole 34*x* of the stop member 34, then slide along the inner peripheral surface of the through hole 34*x*, and then protrudes from the stop member 34. On the other hand, a base end 38*b* located on the opposite side to the blade edge 38*a* is biased in the direction protruding from the revolving member 30*a* (that is, to the radial-directional outer side of the revolving member 30*a*) by the helical compression spring 36 with a washer 33 in between. At that time, both end parts 34*a* and 34*b* of the stop member 34 abut against the bulged parts 38*s* and 38*t* of the cutter 38 and hence the stop member 34 prevents the cutter 38 from falling out to the radial-directional outer side of the revolving member 30*a*.

The helical compression springs 36 bias the cutter 38 to the radial-directional outer side of the revolving member 30*a* by a predetermined biasing force corresponding to the compression amount. Further, when a reaction force acting on the cutter 38 is greater than the predetermined biasing force, the helical compression springs 36 are compressed further so as to permit retraction of the cutter 38, that is, allow the cutter 38 to retract from the position restricted by the stop member 34 toward the inner side of the revolving member 30*a*. The stop member 34 constitutes a stop part that prevents the movement of the cutter 38 biased by the helical compression springs 36 serving as biasing members and thereby holds the cutter 38 at a predetermined position.

That is, at the third step of the web cutting method, in a state that the cutter 38 is held by the revolving member 30*a* and then the cutter 38 is biased to a predetermined position by a biasing force from the helical compression springs 36 arranged in the revolving member 30*a* so that the blade edge 38*a* of the cutter 38 protrudes, the revolving member 30*a* is revolved in synchronization with movement of the anvils 14*a* to 14*e* at the first step so that the web 2 conveyed at the second step is pinched between the blade edge 38*a* of the cutter 38 and the anvil 14*a* so as to be cut. At the third step, when a reaction force greater than the biasing force acts on the blade edge 38*a* of the cutter 38, the helical compression springs 36 allow the cutter 38 to retract from the predetermined position.

When the spring constant and the compression amount of the helical compression springs 36 are appropriately selected, adjustment can easily be achieved such that at the time of cutting the web, a situation can be avoided that the interval between the cutter 38 and the anvil 14*a* becomes excessively large or that the abutting of the cutter 38 against the anvil 14*a* becomes excessively strong. Further, even when the interval or the abutting between the cutter 38 and the anvil 14*a* varies owing to vibration, thermal deformation, or the like during the operation, the interval or the abutting between the cutter 38 and the anvil 14*a* is maintained in an appropriately adjusted state. Thus, long-term continuous running can easily be realized.

The compression amount of the helical compression spring 36 can be changed such that in a state that the nut 39 is loosened, the screw member 37 is rotated from the outside so that the length of protrusion of the tip of the screw member 37 into the spring hole 32*y* is changed and thereby the washer 35 arranged adjacent to the helical compression spring 36 is moved. By virtue of this, without the necessity of exchanging the helical compression spring 36, the biasing force on the cutter 38 can easily be adjusted.

Here, a configuration may be employed that the threaded hole 32*z* is not in fluid communication with the outside. However, when a configuration is employed that the threaded hole 32*z* is in fluid communication with the outside, the biasing force on the cutter 38 can easily be changed by rotating the screw member 37 protruding to the outer space.

In biasing the cutter 38, spring members other than the helical compression springs 36 may be employed. Further, elastic members such as rubber or, alternatively, air cylinders or the like may also be employed. However, spring members are excellent in durability and hence preferable in long-term continuous running. Among such spring members, when the helical compression springs 36 are employed, the configuration of the cutting unit 30 can easily be size-reduced.

The through hole 34*x* is formed in the stop member 34. Then, in the cutter 38 inserted into the through hole 34*x* in a freely slidable manner, the bulged parts 38*s* and 38*t* are received by the both end parts 34*a* and 34*b* of the stop member 34. Thus, the stop member 34 constructed as a single member guides the cutter 38 in a freely slidable manner and restricts the protrusion position of the cutter 38. Thus, the configuration of the cutting unit 30 can be simplified.

Embodiment 2

A web cutting device and a web cutting method of Embodiment 2 are described below with reference to FIGS. 5 to 10. A web cutting device 10*k* of Embodiment 2 has a substantially similar configuration to the web cutting device 10 of Embodiment 1.

Figure 5:
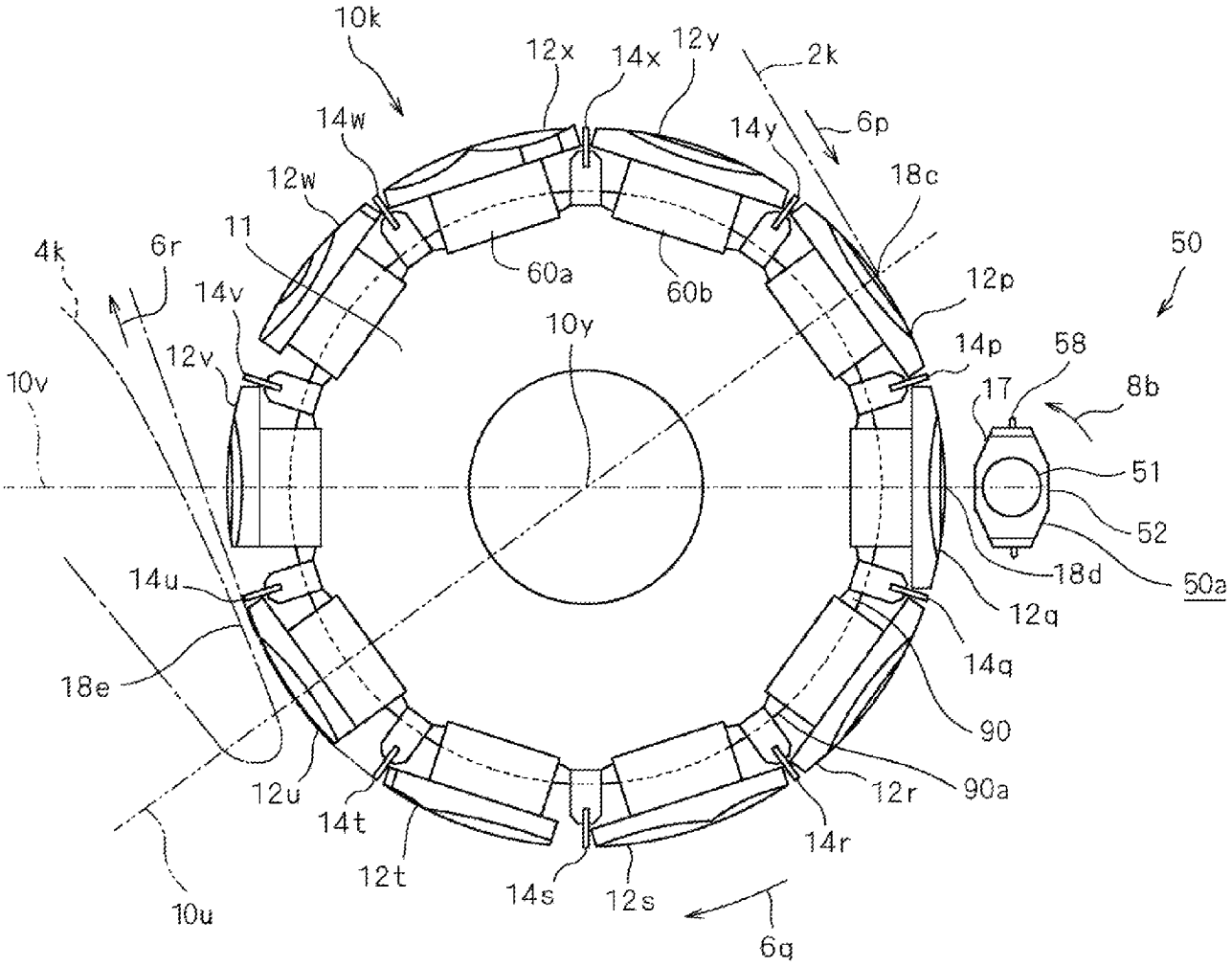
FIG. 5 is a schematic diagram showing the configuration of a web cutting device. (Embodiment 2)

FIG. 5 is a schematic diagram showing the configuration of the web cutting device 10*k*. As shown in FIG. 5, in the web cutting device 10*k*, the pads 12*p* to 12*y* and the anvils 14*p* to 14*y* are arranged along the outer peripheral surface 90*a* of the stationary drum 90, alternately in the circumferential direction of the outer peripheral surface 90*a* of the stationary drum 90. Among the pads 12*p* to 12*y*, the pads 12*p*, 12*r*, 12*t*, 12*v*, and 12*x* in half the number are held by the first travel members 60*a* and the pads 12*q*, 12*s*, 12*u*, 12*w*, and 12*y* in the remaining half are held by the second travel members 60*b*. A vacuum suction hole (not shown) for vacuum-holding a web 2*k* is formed in the surface of each of the pads 12*p* to 12*y*.

A rotating body 11 serving as a driving member is arranged adjacent to the stationary drum 90. The first and the second travel members 60*a* and 60*b* and the anvils 14*p* to 14*y* are fixed to the rotating body 11 and then move in the circumferential direction of the outer peripheral surface 90*a* of the stationary drum 90 as indicated by an arrow 6*q* in association with revolution of the rotating body 11. Here, a configuration may be employed that the first and the second travel members 60*a* and 60*b* are linked to the rotating body 11 through a linkage mechanism and then the first and the second travel members 60*a* and 60*b* move along the outer peripheral surface 90*a* of the stationary drum 90 in the circumferential direction of the stationary drum 90 in association with revolution of the rotating body 11.

At a receiving position 18*c*, the web 2*k* is vacuum-held by the pad 12*p* and then conveyed in the direction indicated by an arrow 6*p* in accordance with the movement of the pad 12*p*. Then, in the web 2*k*, at a cutting position 18*d*, a portion extending between the pads adjacent to each other is pinched between the anvil and a blade edge 58*a* (see FIGS. 6 and 7) of a cutter 58 of a cutting unit 50 revolving in synchronization with the movement of the pads 12*p* to 12*y*, so as to be cut. An individual piece (not shown) obtained by cutting from the web is conveyed in a state of being vacuum-held by the pad and then, at a delivery position 18*e*, the individual piece is transferred from the pad 12*u* to a device 4*k* of the subsequent process. The device 4*k* of the subsequent process conveys the individual piece in the direction indicated by an arrow 6*r*.

Also in the web cutting device 10*k*, the delivery position 18*e* is arranged in an acute angle region between the extension line 10*u* of the imaginary line joining the center axis 10*y* of the stationary drum 90 and the receiving position 18*c* and the extension line 10*v* of the imaginary line joining the center axis 10*y* of the stationary drum 90 and the cutting position 18*d*.

Figure 6:
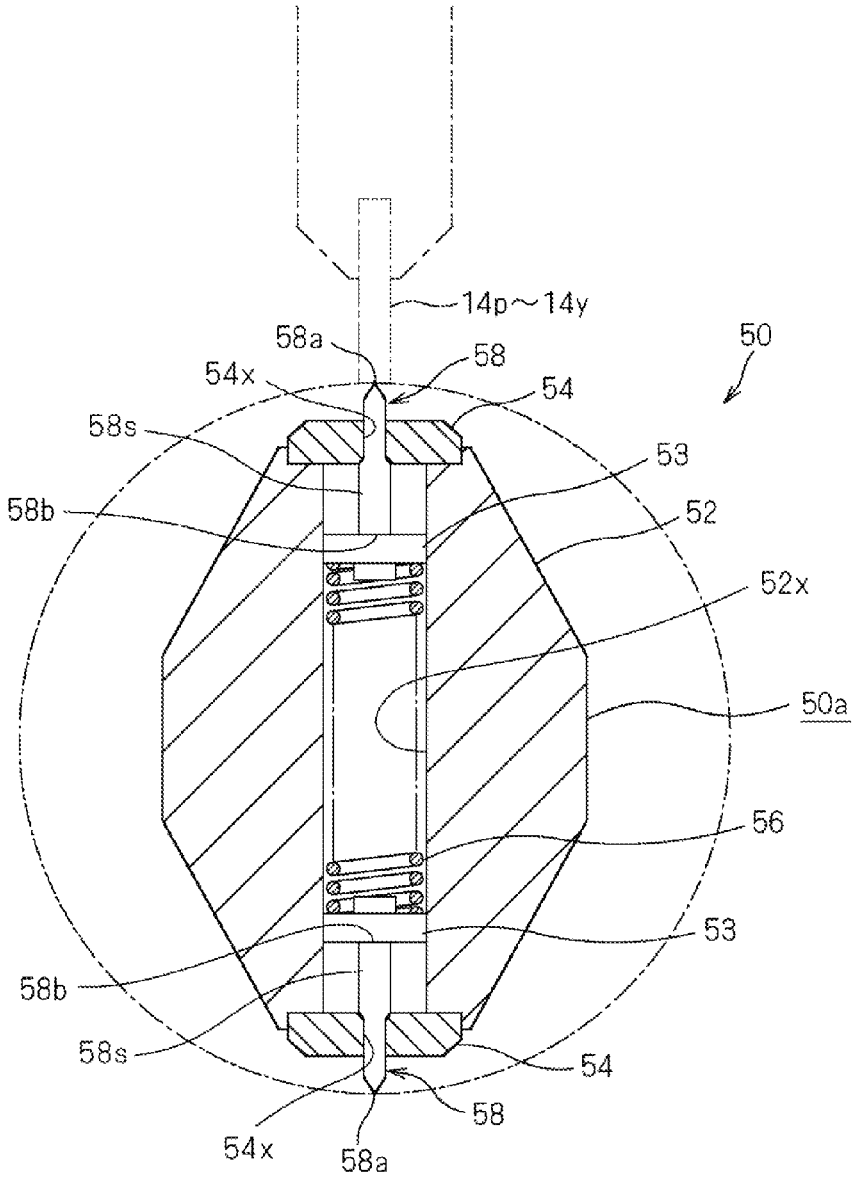
FIG. 6 is a sectional view of a cutting unit. (Embodiment 2)
Figure 7:
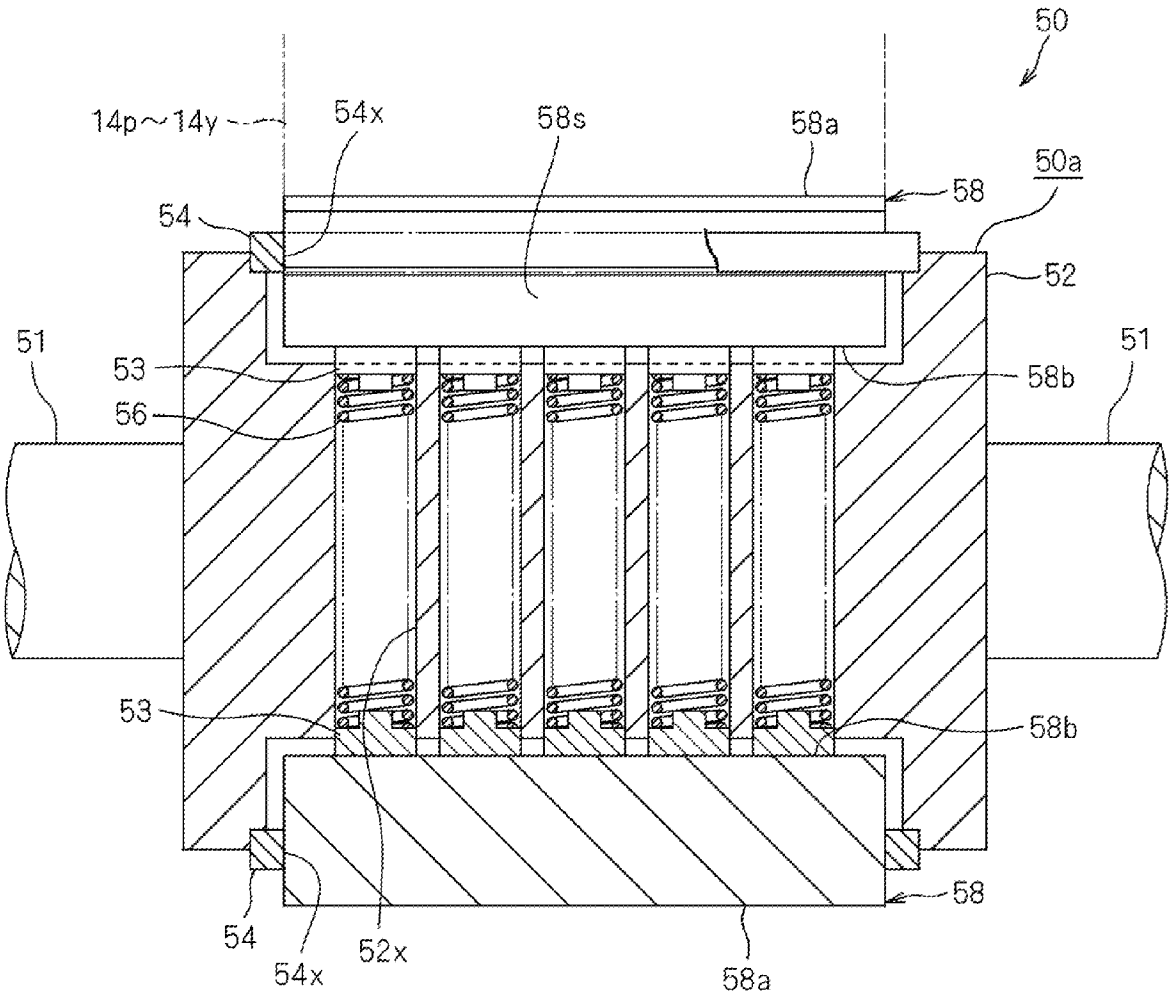
FIG. 7 is a sectional view of a cutting unit. (Embodiment 2)

Next, the cutting unit 50 is described below with reference to FIGS. 6 and 7. FIG. 6 is a sectional view of the cutting unit 50. FIG. 7 is a partly sectional view of the cutting unit 50.

As shown in FIGS. 6 and 7, in the cutting unit 50, a pair of cutters 58 held by a revolving member 50*a* are biased by helical compression springs 56 arranged in a compressed state in the inside of the revolving member 50*a* so that the blade edges 58*a* of the pair of cutters 58 protrude in opposite directions to each other. The revolving member 50*a* includes: a body 52 enclosing the rotational center axis of the revolving member 50*a*; a plurality of stop members 54 fixed to the body 52; and a shaft 51 formed integrally with the body 52 and supported in a freely revolvable manner.

In the body 52 of the revolving member 50*a*, a plurality of through holes 52*x* are formed that extend perpendicularly to the rotational center axis of the revolving member 50*a* and pass through the rotational center axis. The helical compression springs 56 are individually arranged in the through holes 52*x* in a compressed state.

The stop members 54 are respectively fixed to one-end side and the other end side of the through hole 52*x* of the body 52 of the revolving member 50*a*. A through hole 54*x* is formed in the stop member 54.

The cutters 58 are respectively arranged on one-end side and the other end side of the through hole 52*x*. Then, the blade edge 58*a* and a portion continuous to the blade edge 58*a* are inserted into the through hole 54*x* of the stop member 54, then slide along the inner face of the through hole 54*x*, and then protrude to the radial-directional outer side of the revolving member 50*a*. In the cutter 58, the base end 58*b* side opposite to the blade edge 58*a* is pinched between the helical compression spring 56 and the stop member 54 with a washer 53 in between so as to be biased to the radial-directional outer side of the revolving member 50*a* by the helical compression spring 56. The helical compression spring 56 is a biasing member.

The cutter 58 has a bulged part 58*s* located on the base end 58*b* side and protruding to the thickness direction both sides in comparison with the blade edge 58*a* side. The width of the bulged part 58*s* is greater than the width of the through hole 54*x* of the stop member 54. Thus, in the cutter 58 biased to the radial-directional outer side of the revolving member 50*a* by the helical compression springs 56, the bulged part 58*s* abuts against the stop member 54 so that the protruding position is restricted.

In order that the bulged part 58*s* of the cutter 58 may abut against the stop member 54, the helical compression springs 56 bias the cutter 58 to the radial-directional outer side of the revolving member 50*a* to a predetermined position, by a predetermined biasing force corresponding to the compression amount. When a reaction force acting on the blade edge 58*a* of the cutter 58 is greater than the predetermined biasing force, the helical compression spring 56 is further compressed by the reaction force acting on the blade edge 58*a* of the cutter 58 and thereby allows the cutter 58 to retract from the predetermined position restricted by the stop member 54 toward the inner side of the revolving member 50*a*. The stop member 54 constitutes a stop part that prevents the movement of the cutter 58 biased by the helical compression springs 56 serving as biasing members and thereby holds the cutter 58 at a predetermined position.

When the spring constant and the compression amount of the helical compression springs 56 are appropriately selected, at the time of cutting the web, the interval between the cutter 58 and the anvils 14*p* to 14*y* or the abutting of the cutter 58 to the anvils 14*p* to 14*y* can easily be adjusted. Further, even when the interval or the abutting between the cutter 58 and the anvils 14*p* to 14*y* varies owing to vibration, thermal deformation, or the like during the operation, the interval or the abutting between the cutter 58 and the anvils 14*p* to 14*y* is maintained in an appropriately adjusted state. Thus, long-term continuous running can easily be realized.

In the cutting unit 50, the two cutters 58 are attached to the revolving member 50*a* and then the two cutters 58 alternately cut the web. Thus, the replacement cycle of the cutter can be extended in comparison with a case that one cutter is attached to the revolving member. Further, the common helical compression spring 56 is employed for the two cutters 58 and hence the configuration of the cutting unit 50 becomes simple.

Figure 8:
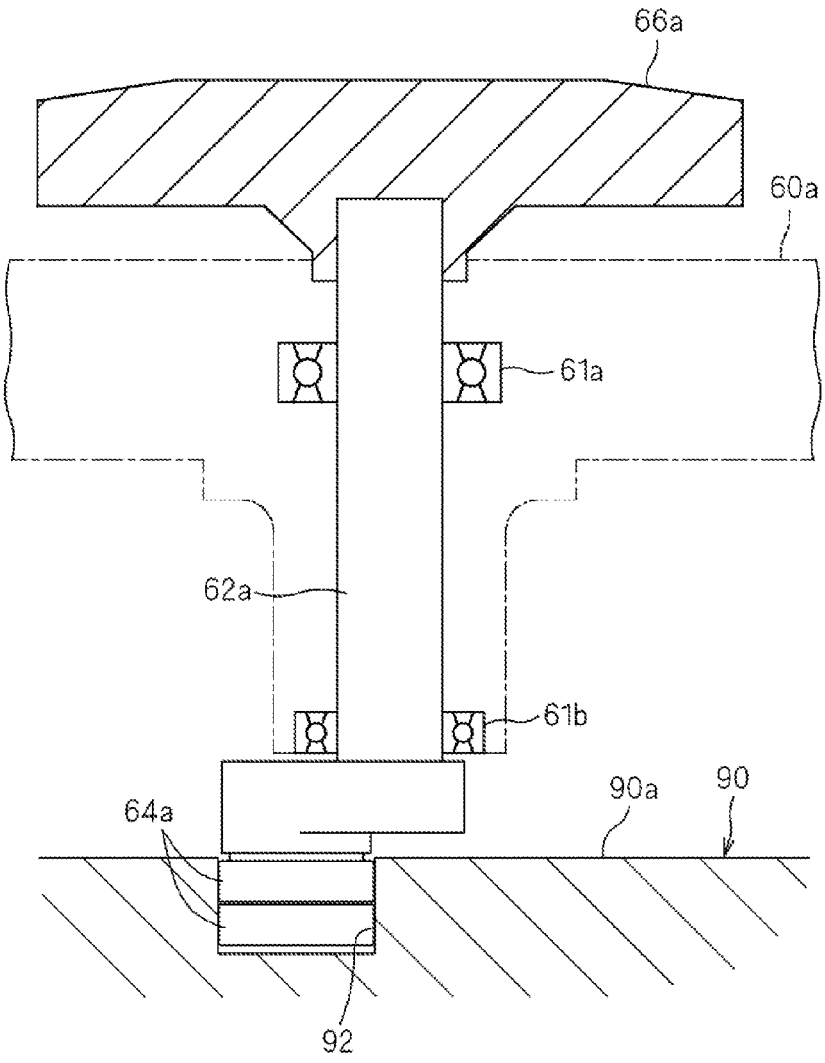
FIG. 8 is a main part sectional view of a first travel member. (Embodiment 2)
Figure 9:
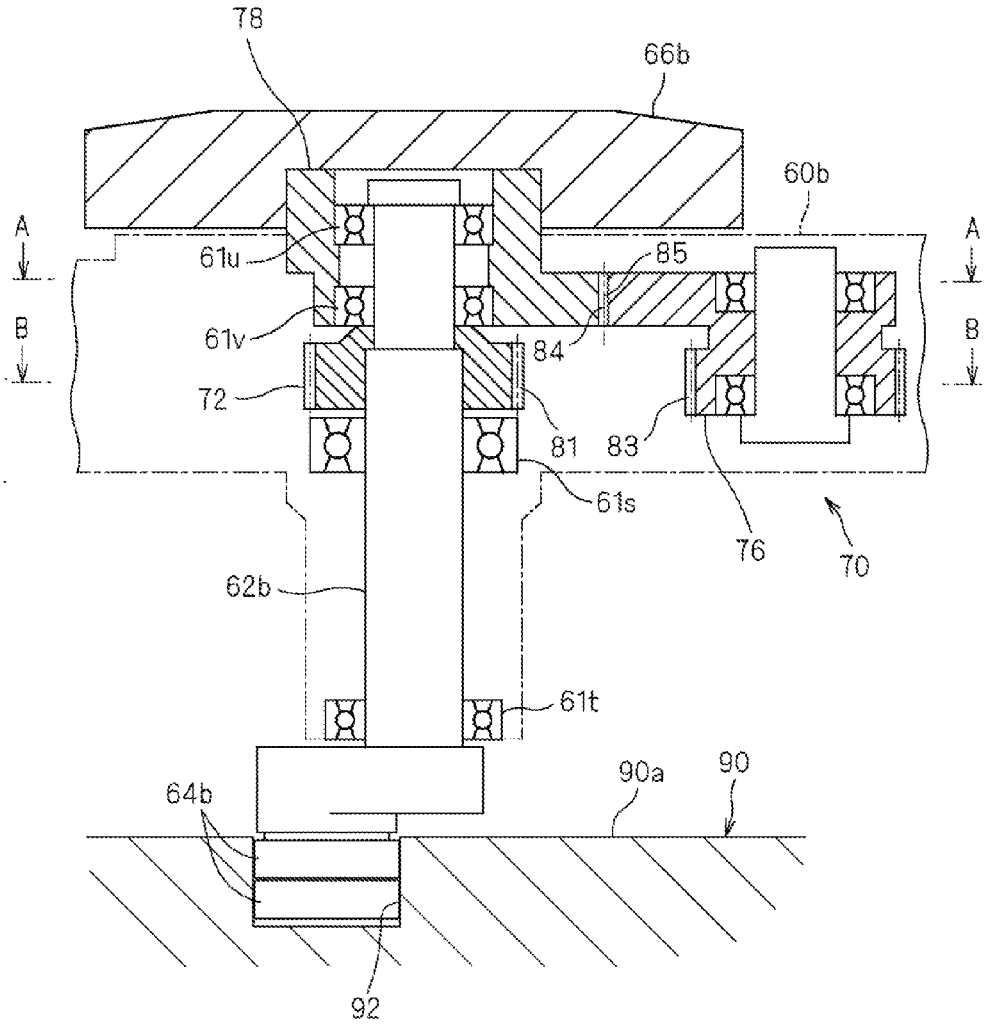
FIG. 9 is a main part sectional view of a second travel member. (Embodiment 2)
Figure 10:
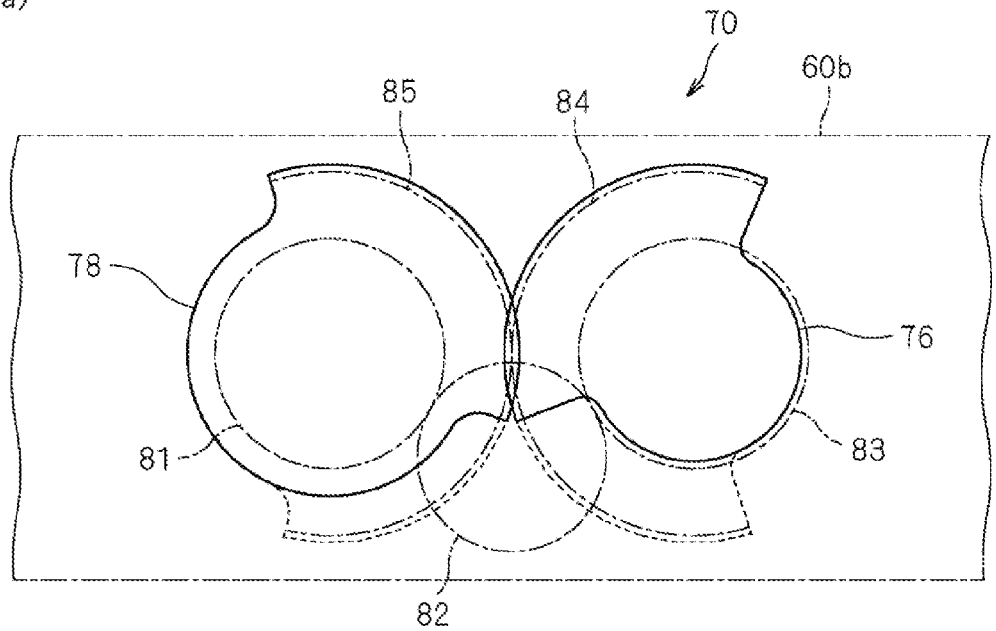
FIGS. 10(*a*) and 10(*b*) are main part sectional views of a second travel member. (Embodiment 2)
Figure 10:
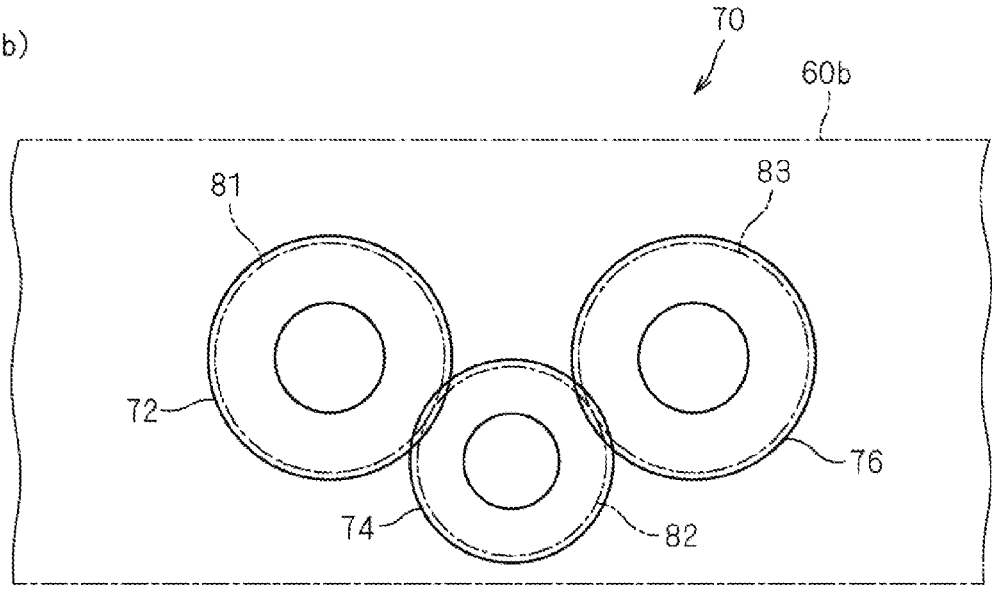
Figure 11:
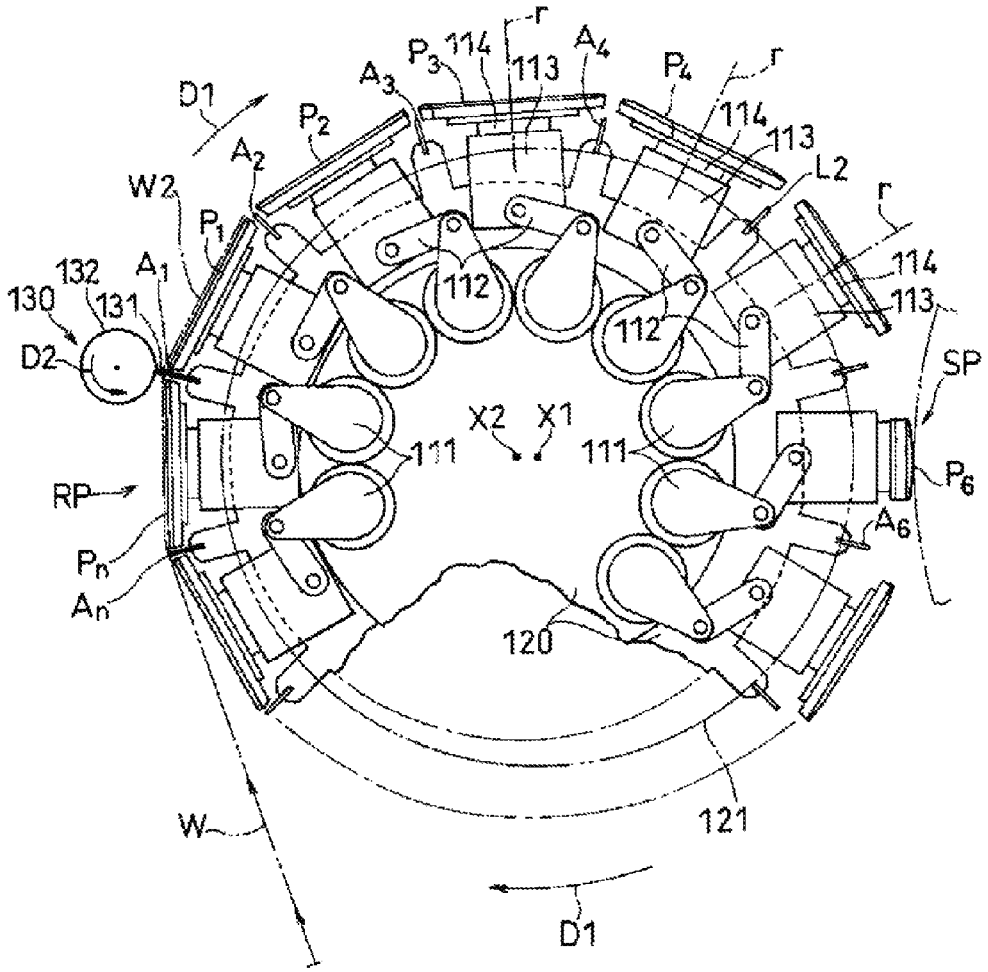
FIG. 11 is a schematic diagram showing the configuration of a web cutting device. (Conventional Example 1)
Figure 12:
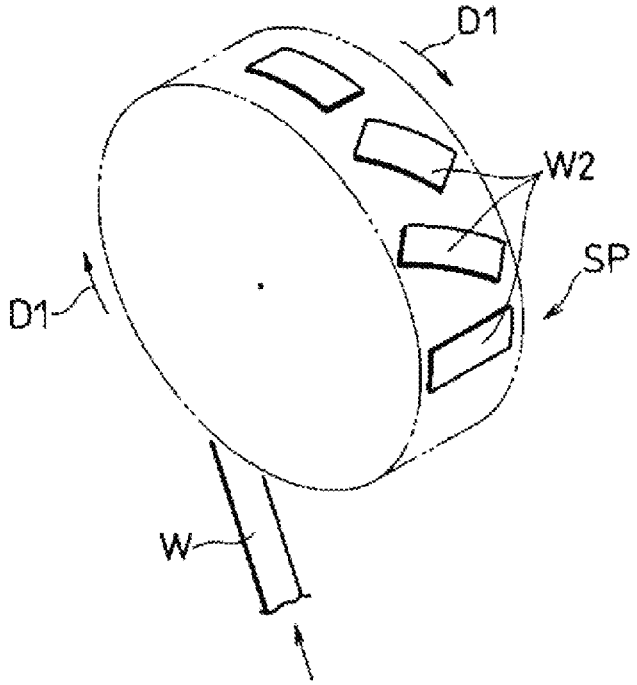
FIG. 12 is a schematic perspective view showing the state of carrying a web. (Conventional Example 1)
Figure 13:
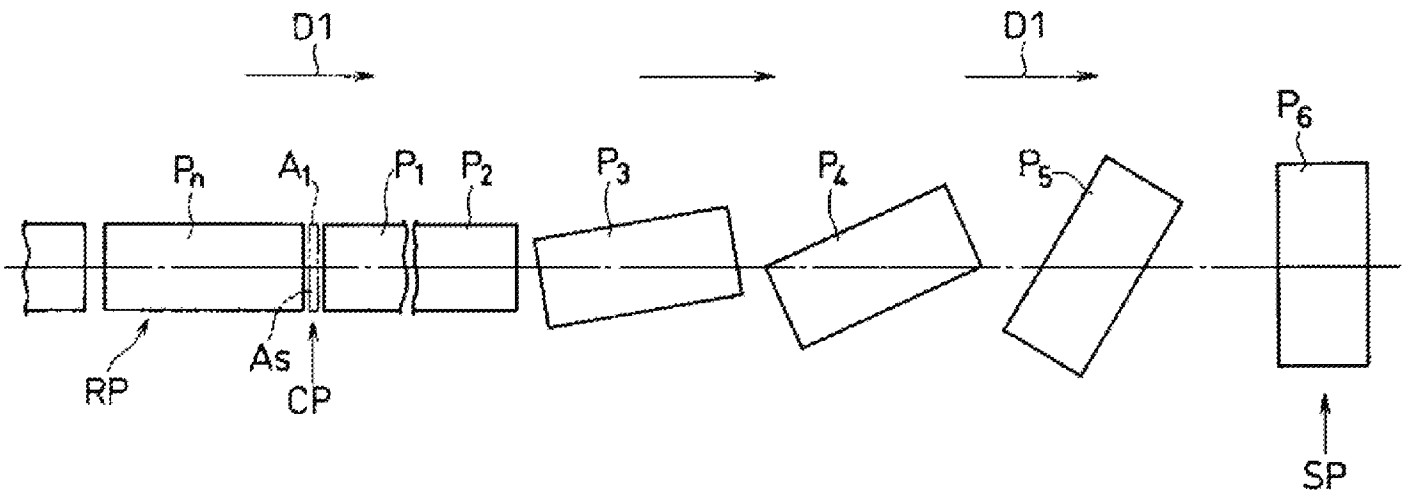
FIG. 13 is a developed view showing the states of movement of pads. (Conventional Example 1)
Figure 14:
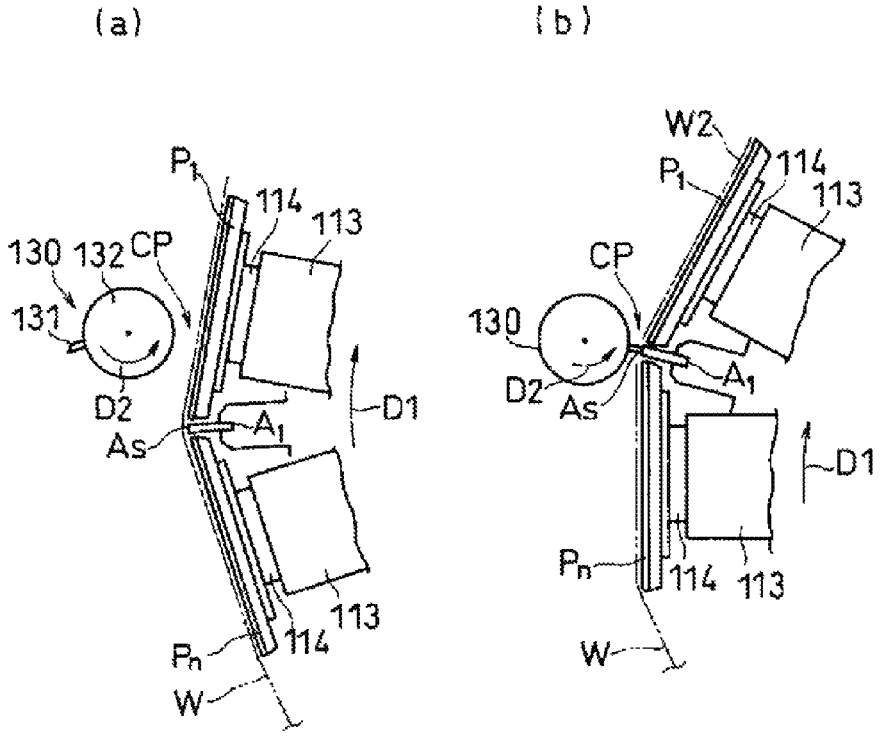
FIGS. 14(*a*) and 14(*b*) are main part enlarged views at the time of web cutting. (Conventional Example 1)
Figure 15:
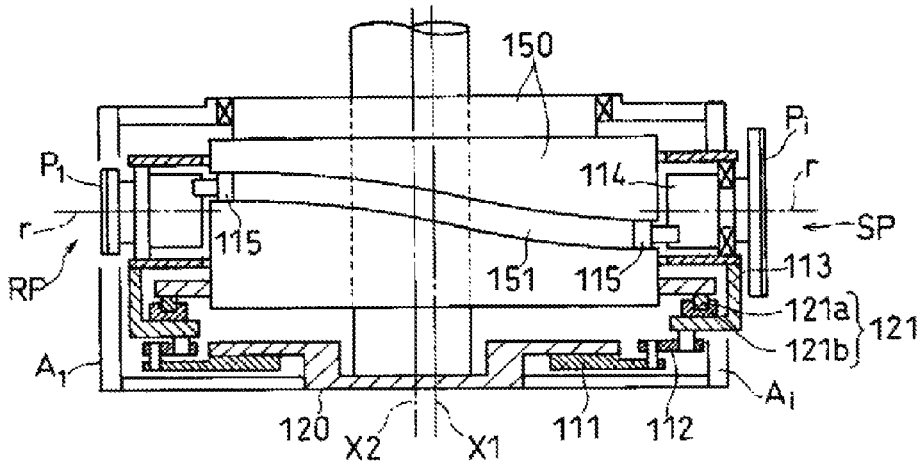
FIG. 15 is a sectional diagram showing the configuration of a web cutting device. (Conventional Example 1)

Next, the pads 12*p* to 12*y* are described below with reference to FIGS. 8 to 10. FIG. 8 is a main part sectional view of a first travel member 60*a*. FIG. 9 is a main part sectional view of a second travel member 60*b*. FIG. 10(*a*) is a main part sectional view taken along line A-A in FIG. 9. FIG. 10(*b*) is a main part sectional view taken along line B-B in FIG. 9.

The pad 66*a* shown in FIG. 8 represents the pads 12*p*, 12*r*, 12*t*, 12*v*, and 12*x* in half the number of the pads 12*p* to 12*y* shown in FIG. 5. Further, the pad 66*b* shown in FIG. 9 represents the pads 12*q*, 12*s*, 12*u*, 12*w*, and 12*y* in the remaining half shown in FIG. 5.

As shown in FIGS. 8 and 9, a cam groove 92 is formed in the outer peripheral surface 90*a* of the stationary drum 90. The cam groove 92 is a guiding part. As described above, the travel members 60*a* and 60*b* individually move in the circumferential direction (a direction perpendicular to the page in FIGS. 8 and 9) of the stationary drum 90 along the outer peripheral surface 90*a* of the stationary drum 90.

In the travel member 60*a* or 60*b*, a shaft member 62*a* or 62*b* is supported in a revolvable manner. The shaft member 62*a* or 62*b* extends in a radial direction of the stationary drum 90. Then, one end is provided with a cam follower 64*a* or 64*b* engaging with the cam groove 92 of the stationary drum 90. The cam follower 64*a* or 64*b* is an engagement part. The shaft member 62*a* or 62*b* moves together with the travel member 60*a* or 60*b* in association with movement of the travel member 60*a* or 60*b*. At that time, the cam follower 64*a* or 64*b* follows the cam groove 92 so that the shaft member 62*a* or 62*b* revolves.

As shown in FIGS. 9 and 10, an opposite-directional rotation mechanism 70 is provided in the second travel member 60*b*. That is, a first gear wheel member 72 is fixed to a middle part of the shaft member 62*b* supported in a revolvable manner by the second travel member 60*b* with bearings 61*s* and 61*t* in between, and then revolves integrally with the shaft member 62*b*. At the other end of the shaft member 62*b* on the opposite side to the one end provided with the cam follower, a fourth gear wheel member 78 is supported coaxially to the shaft member 62*b* in a revolvable manner with bearings 61*u* and 61*v* in between. Further, a second and a third gear wheel member 74 and 76 are arranged in parallel to the shaft member 62*b* and then supported in a revolvable manner by the second travel member 60*b*. The second gear wheel member 74 is a first intermediate wheel member. The third gear wheel member 76 is a second intermediate wheel member.

A first gear wheel 81 is formed in the first gear wheel member 72. A second gear wheel 82 engaging with the first gear wheel is formed in the second gear wheel member 74. In the third gear wheel member 76, a third gear wheel 83 engaging with the second gear wheel 82 and a fourth gear wheel 84 are formed coaxially to each other. A fifth gear wheel 85 engaging with the fourth gear wheel 84 is formed in the fourth gear wheel member 78. When the shaft member 62*b* revolves, the third gear wheel member 76 revolves in the same direction as the shaft member 62*b* by virtue of the engagement of the first to the third gear wheel 81 to 83. The fourth gear wheel member 78 revolves in the opposite direction to the third gear wheel member 76 by virtue of the engagement of the fourth and the fifth gearwheel 84 and 85. That is, the fourth gear wheel member 78 revolves in the opposite direction to the shaft member 62*b*.

In association with movement of the travel member 60*b*, the shaft member 62*b* reciprocally rotates within a range of 90° so that the third and the fourth gear wheel member 76 and 78 rotate within a range of 90° between a position indicated by a solid line in FIG. 10 and a position indicated by a dashed line.

As shown in FIG. 9, the pad 66*b* is fixed to the fourth gear wheel member 78. The pad 66*b* rotates integrally with the fourth gear wheel member 78 in the opposite direction to the shaft member 62*b*. The pad 66*b* is supported in a revolvable manner by the second travel member 60*b* with the shaft member 62*b*, the bearings 61*u* and 61*v*, and the fourth gear wheel member 78 in between.

On the other hand, as shown in FIG. 8, the pad 66*a* is fixed to the other end of the shaft member 62*a* supported in a revolvable manner by the first travel member 60*a* with bearings 61*a* and 61*b* in between. The pad 66*a* rotates integrally with the shaft member 62*a* and rotates in the same direction as the shaft member 62*a*.

That is, among the pads 66*a* and 66*b*, the first pad 66*a* that revolves when revolution of the shaft member 62*a* supported in a revolvable manner by the first travel member 60*a* is transmitted and the second pad 66*b* that revolves when revolution of the shaft member 62*b* supported in a revolvable manner by the second travel member 60*b* is transmitted rotate in opposite directions to each other during the time from the start of holding of the web to the release of the individual piece of the web.

Further, as shown in FIG. 5, the total number of pads is even. Then, among the pads, the first pads 66*a* (see FIG. 8) in half the number and the second pads 66*b* (see FIG. 9) in the remaining half are arranged alternately in the circumferential direction of the stationary drum 90.

Thus, after cutting the web, the web cutting device 10*k* can transfer the individual pieces obtained by cutting from the web, to the subsequent device in a state that the orientations are alternately changed. The cam groove 92 serving as a guiding part is common to each other. Further, it is sufficient that the opposite-directional rotation mechanism 70 for alternately changing the orientations of the individual pieces is provided in each of the second travel members 60*b*, that is, in half the number of the travel members 60*a* and 60*b*. Thus, the configuration of the web cutting device 10*k* becomes simple.

The first pad 66*a* is directly connected to the shaft member 62*a* supported in a revolvable manner by the first travel member 60*a*. Thus, any mechanism for transmitting the revolution is not provided between the shaft member 62*a* and the first pad 66*a*. Thus, the configuration of transmitting the revolution of the shaft member 62*a* so as to rotate the pad 66*a* can be simplified.

The second pad 66*b* rotates coaxially to the shaft member 62*b* supported in a revolvable manner by the second travel member 60*b*. Thus, a configuration can easily be constructed that the first pad 66*a* and the second pad 66*b* rotate in opposite directions to each other. The first to the fifth gear wheel 81 to 85 of the opposite-directional rotation mechanism 70 are excellent in durability in comparison with a belt, a chain, or the like and hence are preferable in long-term continuous running.

CONCLUSION

As described above, in the web cutting device and the web cutting method of Embodiments 1 and 2, long-term continuous running becomes easy. Further, in the web cutting device and the web cutting method of Embodiment 2, the orientation of an individual piece obtained by cutting can be changed at the time of transfer of the individual piece by employing a simple configuration.

Here, the present invention is not limited to the modes of implementation given above and may be implemented with various changes.

For example, a member like the pad described in the form of a single member in the embodiments may be constructed from a single component part or, alternatively, from a plurality of component parts integrated into a single member.

A configuration without the stationary drum may be employed. For example, a configuration may be employed that pads and anvils are held along a revolving drum and then the revolving drum revolves so that the pads and the anvils are moved along a cylindrical movement path in the circumferential direction.

DESCRIPTION OF REFERENCE NUMERALS

10, 10*k* Web cutting device
10*x*, 10*y* Center axis of stationary drum
12*a* to 12*e*, 12*p* to 12*y* Pad
14*a* to 14*e*, 14*p* to 14*y* Anvil
30*a* Revolving member
32*x* Groove
32*y* Spring hole
32*z* Threaded hole
34 Stop member (stop part)
34*x* Through hole
36 Helical compression spring (compression spring, biasing member)
37 Screw member (biasing force adjusting member)
38 Cutter
38*a* Blade edge
38*s*, 38*t* Bulged part
50*a* Revolving member
52*x* Through hole
54 Stop member (stop part)
54*x* Through hole
56 Helical compression spring (compression spring, biasing member)
58 Cutter
58*a* Blade edge
58*s* Bulged part
90 Stationary drum
90*a* Outer peripheral surface
W Web

The invention claimed is:

1. A web cutting device comprising:

a plurality of pads that move in a circumferential direction along a cylindrical movement path and hold a web in a releasable manner;

a plurality of anvils that are arranged between the pads adjacent to each other and that move in the circumferential direction together with the pads;

a revolving member that is arranged, with an interval in between, opposite to the web moved in a state of being held by the pads and that revolves in synchronization with movement of the anvils;

a cutter that is held by the revolving member in a manner of being retractable from a predetermined position toward the inner side of the revolving member and that has a blade edge protruding to the outer side of the revolving member and, when the blade edge becomes such as to face the anvil in association with revolution of the revolving member, cuts the web pinched between the blade edge and the anvil; and a biasing member that biases the cutter to the outer side of the revolving member by using a predetermined biasing force so as to hold the cutter at the predetermined position and, on the other hand, when a reaction force acting on the blade edge of the cutter is greater than the predetermined biasing force, allows the cutter to retract from the predetermined position.

2. The web cutting device according to claim 1, wherein the revolving member includes a stop part that prevents movement of the cutter biased by the biasing member and thereby holds the cutter at the predetermined position.

3. The web cutting device according to claim 1, wherein the biasing member is a spring member and is arranged in an inside of the revolving member.

4. The web cutting device according to claim 1, wherein the revolving member includes a biasing force adjusting member capable of changing the predetermined biasing force.

5. The web cutting device according to claim 4, wherein the spring member is a compression spring, wherein the revolving member is provided with a body enclosing a rotational center axis of the revolving member and with a stop member fixed to the body and constituting the stop part, wherein in the body, formed are:

a groove which extends in parallel to the rotational center axis and in which the stop member is arranged;

a spring hole which is in fluid communication with the groove, which extends perpendicularly to the rotational center axis, and in which the compression spring is arranged in a compressed state; and a threaded hole that extends perpendicularly to the rotational center axis from the spring hole to a side opposite to the groove and that is in fluid communication with an outside, wherein the biasing force adjusting member is a screw member screwed into the threaded hole, and wherein a compression amount of the compression spring can be changed in accordance with a length of protrusion of the screw member into the spring hole.

6. The web cutting device according to claim 3, wherein:

the spring member is a compression spring;

the revolving member is provided with a body enclosing a rotational center axis of the revolving member and with a plurality of stop members fixed to the body and constituting the stop parts;

in the body, a through hole is formed that extends perpendicularly to the rotational center axis and passes through the rotational center axis;

the compression spring is arranged in the through hole;

the stop members are fixed to the body respectively on one-end side and the other end side of the through hole; and the cutters are respectively arranged on one-end side and the other end side of the through hole, then each located between the compression spring in a compressed state and the stop member, and then biased to a radial-directional outer side of the revolving member by the compression spring.

7. The web cutting device according to claim 1, wherein:

the cutter has bulged parts protruding to both sides of a direction parallel to the direction in which the blade edge extends; and when the cutter is held at the predetermined position by the revolving member, the bulged parts abut against the stop part of the revolving member and then, when the cutter retracts from the predetermined position, depart from the stop part of the revolving member.

8. The web cutting device according to claim 1, wherein:

the cutter has a bulged part protruding to both sides of a thickness direction; and when the cutter is held at the predetermined position by the revolving member, the bulged part abuts against the stop part of the revolving member and then, when the cutter retracts from the predetermined position, departs from the stop part of the revolving member.

9. The web cutting device according to claim 1, wherein the revolving member has a through hole into which the blade edge of the cutter and a portion continuous to the blade edge are inserted.

10. A web cutting method comprising:

a first step of moving a plurality of pads and a plurality of anvils arranged alternately along a cylindrical movement path, in a circumferential direction of the movement path;

a second step of holding a web by using the pads moving at the first step and conveying the web in a state that the anvil moving at the first step faces a portion of the web extending between the pads adjacent to each other; and a third step of, in a state that a cutter is held by a revolving member and then the cutter is biased to a predetermined position by a biasing force from a biasing member arranged in the revolving member so that a blade edge of the cutter is caused to protrude, revolving the revolving member in synchronization with movement of the anvils at the first step and thereby pinching, between the blade edge of the cutter and the anvil, the web conveyed at the second step so as to cut the web, wherein at the third step, when a reaction force greater than the biasing force acts on the blade edge of the cutter, the biasing member allows the cutter to retract from the predetermined position toward an inner side of the revolving member.

11. The web cutting method according to claim 10, wherein the biasing member is a spring member.

12. The web cutting method according to claim 11, wherein:

the spring member is a helical compression spring arranged in an inside of the revolving member; and the revolving member holds a pair of the cutters arranged on both sides in an axial direction of the helical compression spring in a compressed state and then causes the blade edges of a pair of the cutters to protrude in opposite directions to each other.

* * * * *